US005448254A

United States Patent [19]

Schneeman et al.

[11] Patent Number: 5,448,254

[45] Date of Patent: Sep. 5, 1995

[54] MECHANISM FOR MOUNTING A RECEIVING/TRANSMITTING HORN IN A SATELLITE DISH

[75] Inventors: Lloyd R. Schneeman, Indianapolis; Robert J. Ramspacher, Fishers, both of Ind.

[73] Assignee: Thomson Consumer Electronics, Inc., Indianapolis, Ind.

[21] Appl. No.: 220,417

[22] Filed: Mar. 31, 1994

[51] Int. Cl.[6] ..... H01Q 19/14

[52] U.S. Cl. ..... 343/781 R; 343/840; 343/906

[58] Field of Search ..... 343/781 R, 786, 840, 343/878; 333/260; 439/359, 521, 928; 455/3.2, 280; H01Q 19/12, 19/13, 13/02, 1/50

[56] References Cited

U.S. PATENT DOCUMENTS 2,534,271 12/1950 Kienow ..... 343/786

FOREIGN PATENT DOCUMENTS 0149206 8/1985 Japan ..... 343/840

5029830 2/1993 Japan ..... H01Q 19/12

OTHER PUBLICATIONS

Das Nonplusultra. Perfekte Losungen fur grenzenlosen Satellitenempfang, Sat-Antenne zum Aufklappen 18/1993 FUBA Hans Lolbe & Co.

Funkschau Magazin Fur Telekommunikation und Unterhalungselektronik No. 18 Aug. 20, 1993, cover.

*Primary Examiner*—Donald Hajec

*Assistant Examiner*—Tho Phan

*Attorney, Agent, or Firm*—Joseph S. Tripoli; Peter M. Emanuel; Frederick A. Wein

[57] ABSTRACT

A mechanism for mounting a receiving/transmitting horn in a satellite dish includes a casing for supporting the horn and for shielding the coaxial cable connectors and a low noise block from rain, snow, wind and the sun. The casing includes a recessed portion arranged at an angle with respect to the longitudinal axis of the casing. The recessed portion slides into a feed-arm in a weatherproof manner. The longitudinal axis of the feed-arm is offset from the axis of the satellite dish. The casing, feed-arm, angle and horn support are dimensioned to optimally position the horn at the focal point of the parabolic dish.

5 Claims, 1 Drawing Sheet

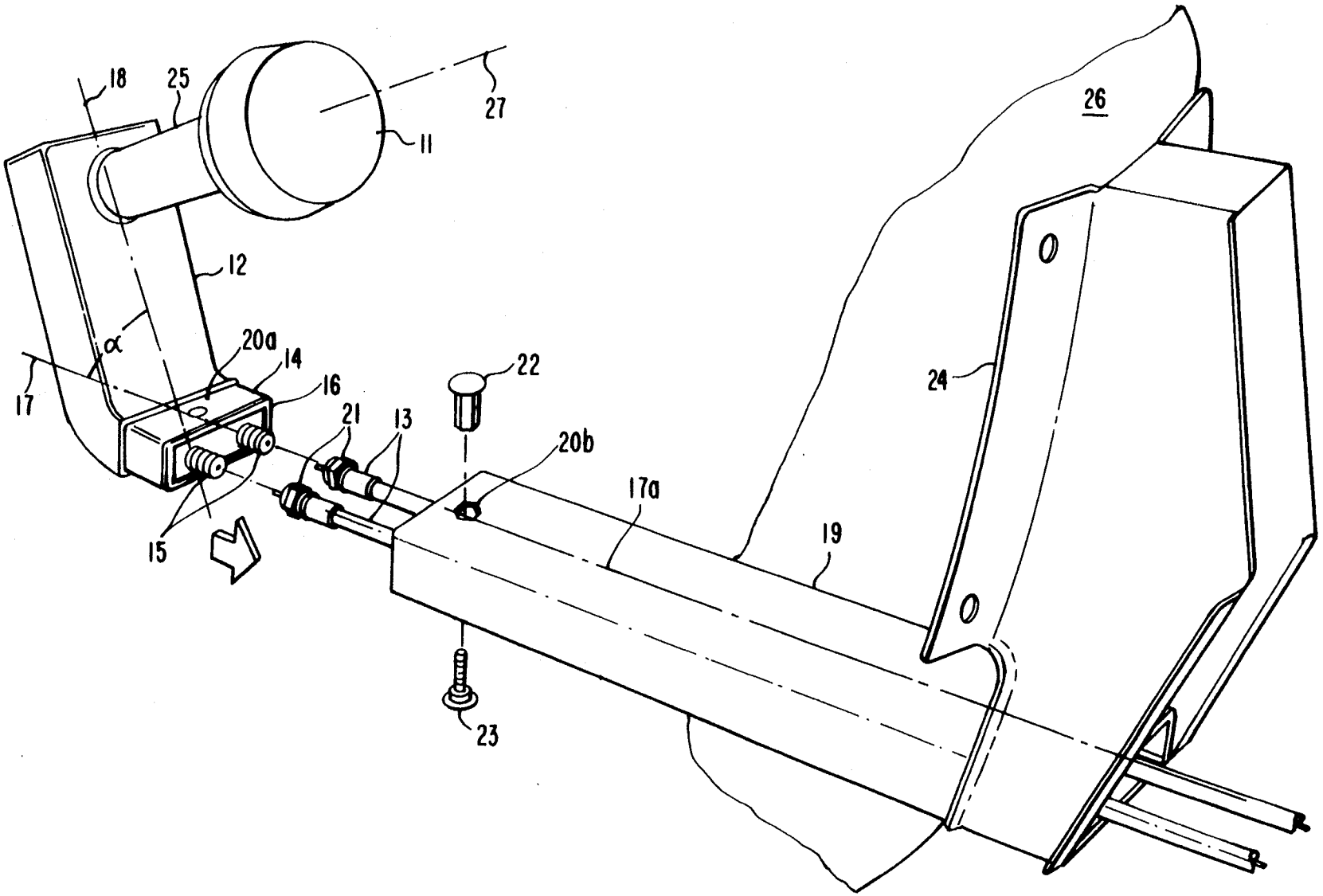
26
24
19
17a
20b
22
23
27
11
13
21
16
14
20a
12
25
18
15
17
α

MECHANISM FOR MOUNTING A RECEIVING/TRANSMITTING HORN IN A SATELLITE DISH

This invention relates generally to satellite dishes for television and other communication equipment and particularly to a mechanism for mounting a receiving/-transmitting horn in such dishes.

BACKGROUND

Satellite dishes for television and other types of receiving/transmitting dishes are exposed to the environment and as such are subject to exposure to water, snow, wind, sun and other environmental related stresses. These stresses are detrimental to the electronic equipment and it therefore is necessary to protect the electronic components and coaxial cables from the exposure to snow and water and also to physically stabilize the receiving/transmitting horn against the wind to maintain the physical position of the horn within the satellite dish. The present invention possesses these advantages and is also advantageous in that it permits easy installation and automatic alignment of the horn within the dish.

SUMMARY

A mechanism for mounting a receiving/transmitting horn in a satellite dish includes a substantially weatherproof casing which supports the horn and in which a low noise block converter (LNB) is arranged to connect coaxial cable connectors to the horn. The casing includes a recessed portion angularly arranged at an angle $\alpha$ with respect to the axis of the casing. Coaxial cable connectors pass through the recessed portion and an insulative retainer immovably holds the coaxial cable connectors in the recessed portion. A substantially weatherproof feed-arm has internal dimensions selected to receive the recessed portion in a substantially weatherproof manner. Coaxial cables are slideably supported in the feed-arm and are connected to the coaxial cable connectors. A flange affixes the mechanism to the satellite dish.

BRIEF DESCRIPTION OF THE DRAWINGS

The FIGURE is a preferred embodiment.

DETAILED DESCRIPTION

In the FIGURE, a receiving/transmitting horn 11 is affixed to a weatherproof casing 12 which encloses a low noise block converter (LNB). The LNB connects male coaxial cable connectors 15 to the horn 11. Casing 12 includes a recessed portion 14, the external dimensions of which are slightly smaller than the external dimensions of the casing 12. The male coaxial cable connectors 15 extend from the recessed portion 14. The coaxial connectors 15, and thus also the LNB to which they are connected, are held immovable within recessed portion 14 by an insulating retainer 16. This eliminates the possibility of damaging the LNB when the casing 12 is joined with a feed-arm 19. The longitudinal axis 17 of the recessed portion 14 is disposed at an angle $\alpha$ with respect to the longitudinal axis 18 of the weatherproof casing 12. A support 25 is normal to the casing 12 and fixes horn 11 to the casing.

The feed-arm 19 has internal dimensions which are selected such that the feed-arm receives recessed portion 14 in a substantially weatherproof manner and if necessary seals can be used. The coaxial cables 13 are slideably arranged within the feed-arm 19 but are constrained from transverse movement with respect to the four sides of the feed-arm. The coaxial cables 13 are terminated with female coaxial connectors 21 which thread onto the male connectors 15. Because coaxial cables 13 are slideable within feed-arm 19, recessed portion 14 can be slid into the end of feed-arm 19 without physically stressing any electronic components contained within casing 12.

A flange 24 is permanently fixed to the distal end of feed-arm 19. The flange 24 has the same parabolic configuration and dimensions as the outside surface of the satellite dish 26. The feed-arm 19 passes through an aperture within the dish 26. The longitudinal axis 17*a* of the side of feed-arm 19 coincides with the longitudinal axis 17 of recessed portion 14 and is offset from the axis 27 of parabolic dish 26. This results in the advantages of permitting the feed-arm 19 to be straight, making it easier to pass coaxial cables 13 through the feed-arm and also making it less expensive to fabricate the feed-arm. The feed-arm 19, casing 12, support 25 and angle $\alpha$ are dimensioned such that the horn 11 is optimally positioned at the focal point of the parabolic satellite dish 26. The cross sectional configuration of recessed portion 14 and feed-arm 19 preferably is rectangular, as shown. However, if ease of manufacture or cost benefits dictate that a different configuration should be used, the configuration should be chosen to have at least one flat surface to minimize the possibility of the two members moving with respect to one another due to the effects of wind, temperature changes and other environmental effects.

Apertures 20*a* and 20*b* are present in the recessed portion 14 and feed-arm 19, respectively. Apertures 20*a* and 20*b* are positioned within the respective members such that they are in alignment when the two members 14 and 19 are joined together. A special nut 22, which is congruent to the apertures 20*a* and 20*b*, and a screw 23 pass through the apertures 20*a* and 20*b* to physically maintain the recessed portion 14 and feed-arm 19 together. The apertures 20*a* and 20*b* and nut 22 preferably are configured to have at least one flat side so that nut 22 can not rotate within the apertures.

We claim:

1. A mechanism for mounting a receiving/transmitting horn in a satellite dish comprising:

a substantially weatherproof casing supporting said horn;

a low noise block converter arranged in said casing and connecting at least one coaxial cable connector to said horn;

said casing including a recessed portion angularly arranged at an angle $\alpha$ with respect to a longitudinal axis of said casing, said at least one coaxial cable connector passing through said recessed portion;

an insulative retainer immovably holding said at least one coaxial cable connector in said recessed portion;

a substantially weatherproof feed-arm having internal dimensions selected to receive said recessed portion in a substantially weatherproof manner, at least one cable slideably supported in said feed-arm for connection to said at least one coaxial cable connector; and means for affixing said mounting to said satellite dish.

2. The mechanism of claim 1 wherein said satellite dish has an axis and said feed-arm has a longitudinal axis vertically offset from said axis.

3. The mechanism of claim 2 further including a support affixing said horn to said casing.

4. The mechanism of claim 3 wherein said weather proof casing, said feed-arm, said support, and said angle $\alpha$ are dimensioned to optimally position said horn at the focal point of said dish.

5. The mechanism of claim 3 wherein said casing and said feed-arm have a cross-sectional configuration including at least one flat side.

* * * * *